US006591795B2

(12) United States Patent
Janak

(10) Patent No.: US 6,591,795 B2
(45) Date of Patent: Jul. 15, 2003

(54) CAPTIVE VOLUME ACCUMULATOR FOR A LOST MOTION SYSTEM

(75) Inventor: Robb Janak, Somers, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 10/144,708

(22) Filed: May 15, 2002

(65) Prior Publication Data

US 2002/0157624 A1 Oct. 31, 2002

Related U.S. Application Data

(62) Division of application No. 09/663,414, filed on Sep. 15, 2000, now Pat. No. 6,415,752.
(60) Provisional application No. 60/154,473, filed on Sep. 17, 1999.

(51) Int. Cl.[7] ..... F01L 9/02
(52) U.S. Cl. ..... 123/90.12; 123/90.15; 123/90.16; 123/90.44; 123/90.46
(58) Field of Search ..... 123/90.12, 90.15, 123/90.16, 90.33, 90.36, 90.39, 90.43, 90.44, 90.46, 90.55, 322

(56) References Cited

U.S. PATENT DOCUMENTS 3,220,392 A 11/1965 Cummins
3,612,015 A 10/1971 Hausknecht
3,786,792 A 1/1974 Pelizzoni et al.
3,809,033 A 5/1974 Cartledge
4,278,233 A 7/1981 Zurner et al.
4,399,787 A 8/1983 Cavanagh
4,502,428 A 3/1985 Paar
4,572,114 A 2/1986 Sickler
4,624,224 A 11/1986 Kodama et al.
4,644,914 A 2/1987 Morita et al.

(List continued on next page.)

*Primary Examiner*—Teresa Walberg
*Assistant Examiner*—Fadi H. Dahbour
(74) *Attorney, Agent, or Firm*—Collier Shannon Scott, PLLC; David R. Yohamnan; Mark W. Rygiel

(57) ABSTRACT

The present invention is directed to an innovative, economical method or system disclosing a captive volume in a hydraulic circuit which can be selectively hydraulically or pneumatically locked, or vented in order to correspondingly maintain, or increase the total volume of the hydraulic circuit. The structural elements of an embodiment of the present invention may include an accumulator with or without a fixed solid stop, which limits its travel. The accumulator can either be a separate entity, or as an assembly within the master or slave pistons.

26 Claims, 11 Drawing Sheets

U.S. PATENT DOCUMENTS 4,677,723 A 7/1987 Greene, Sr.
4,716,867 A 1/1988 Speil
4,724,801 A 2/1988 O'Neill
4,800,851 A 1/1989 Hertrich et al.
5,036,810 A 8/1991 Meneely
5,146,890 A 9/1992 Gobert et al.
RE34,553 E 3/1994 Konno
RE34,596 E 5/1994 Masuda et al.
5,327,858 A 7/1994 Hausknecht
5,495,838 A 3/1996 Johnson, Jr.
5,507,261 A 4/1996 Johnson, Jr.
5,564,385 A 10/1996 Hakansson
5,586,531 A 12/1996 Vittorio
5,609,133 A 3/1997 Hakansson
5,619,965 A 4/1997 Cosma et al.
5,626,116 A 5/1997 Reedy et al.
5,632,237 A 5/1997 Cornell et al.
5,647,318 A 7/1997 Feucht et al.
5,680,841 A 10/1997 Hu
5,706,771 A 1/1998 Van Heyningen et al.
5,746,175 A 5/1998 Hu
5,829,397 A * 11/1998 Vorih et al. ..... 123/90.12
5,839,453 A 11/1998 Hu
5,857,438 A 1/1999 Barnard
5,890,469 A 4/1999 Hakansson et al.
5,975,251 A 11/1999 McCarthy
5,996,550 A * 12/1999 Israel et al. ..... 123/322
6,000,374 A 12/1999 Cosma et al.
6,085,705 A * 7/2000 Vorih ..... 123/90.12
6,112,710 A * 9/2000 Egan, III et al. ..... 123/90.12
6,152,104 A * 11/2000 Vorih et al. ..... 123/322
6,192,841 B1 * 2/2001 Vorih et al. ..... 123/90.12
6,244,257 B1 6/2001 Hu
6,257,183 B1 7/2001 Vorih et al.
6,267,098 B1 * 7/2001 Vanderpoel ..... 123/90.15
6,293,237 B1 * 9/2001 Vorih ..... 123/90.12
6,321,701 B1 11/2001 Vorih et al.
6,412,457 B1 * 7/2002 Vorih et al. ..... 123/90.12

* cited by examiner

CAPTIVE VOLUME ACCUMULATOR FOR A LOST MOTION SYSTEM

CROSS REFERENCE TO RELATED APPLICATIONS

The present application is a division of Ser. No. 09/663,414 filed Sep. 15, 2000, now U.S. Pat. No. 6,415,752 and claims priority on U.S. Provisional Patent Application No. 60/154,473, filed Sep. 17, 1999.

FIELD OF THE INVENTION

The present invention relates generally to a system and method for opening at least one valve in an internal combustion engine. More specifically the invention relates to a system and method, used both during positive power and engine braking engine operating conditions, for controlling the amount of "lost motion" between the at least one valve and an assembly for opening the at least one valve.

BACKGROUND OF THE INVENTION

Valve actuation in an internal combustion engine is required in order for the engine to produce positive power, as well as to produce engine braking. During positive power, intake valves may be opened to admit fuel and air into a cylinder for combustion. The exhaust valves may be opened to allow combustion gas to escape from the cylinder.

During engine braking, the exhaust valves may be selectively opened to convert, at least temporarily, an internal combustion engine of compression-ignition type into an air compressor. In doing so, the engine develops retarding horsepower to help slow the vehicle down. This can provide the operator with increased control over the vehicle and substantially reduce wear on the service brakes of the vehicle. A properly designed and adjusted compression release-type engine brake can develop retarding horsepower that is a substantial portion of the operating horsepower developed by the engine in positive power.

In many internal combustion engines the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift to optimize valve opening times and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic, or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a minimum amount of the cam motion to the valve. An example of such a system and method is provided in Hu, U.S. Pat. Nos. 5,537,976 and 5,680,841, which are assigned to the same assignee as the present application and which are incorporated herein by reference.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may be a solenoid valve and a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston.

Previous lost motion systems have typically not utilized high speed mechanisms to rapidly vary the length of the lost motion system. Lost motion systems of the prior art have accordingly not been variable such that they may assume more than one length during a single cam lobe motion, or even during one cycle of the engine. By using a high speed mechanism to vary the length of the lost motion system, more precise control may be attained over valve actuation, and accordingly optimal valve actuation may be attained for a wide range of engine operating conditions.

The lost motion system and method of the present invention may be particularly useful in engines requiring valve actuation for both positive power and for compression release retarding and exhaust gas recirculation valve events. Typically, compression release and exhaust gas recirculation events involve much less valve lift than do positive power related valve events. Compression release and exhaust gas recirculation events may however require very high pressures and temperatures to occur in the engine. Accordingly, if left uncontrolled (which may occur with the failure of a lost motion system), compression release and exhaust gas recirculation could result in pressure or temperature damage to an engine at higher operating speeds. Therefore, it may be beneficial to have a lost motion system which is capable of providing control over positive power, compression release, and exhaust gas recirculation events, and which will provide only positive power or some low level of compression release and exhaust gas recirculation valve events, should the lost motion system fail.

An example of a lost motion system and method used to obtain retarding and exhaust gas recirculation is provided by the Gobert, U.S. Pat. No. 5,146,890 (Sep. 15, 1992) for a Method And A Device For Engine Braking A Four Stroke Internal Combustion Engine, assigned to AB Volvo, and incorporated herein by reference. Gobert discloses a method of conducting exhaust gas recirculation by placing the cylinder in communication with the exhaust system during the first part of the compression stroke and optionally also during the latter part of the inlet stroke. Gobert uses a lost motion system to enable and disable retarding and exhaust gas recirculation, but such system is not variable within an engine cycle.

The development of lost motion systems has also lead to the integration of such systems into existing engine components, as opposed to adding such systems aftermarket. One particular form of system integration that appears desirable is the integration of the lost motion system into an engine rocker arm, such as is shown in Hu, U.S. Pat. No. 5,680,841. By integrating the lost motion system into the engine rocker arm, savings in weight, size, and cost may be available.

All of the foregoing developments, such as high speed lost motion actuation, and rocker arm integration, have necessitated independently and collectively, smaller, faster, more robust, more controllable, and more compliant lost motion components. One such component that requires improvement to meet the needs of these new and advanced lost motion systems is the system accumulator.

Lost motion systems may require the use of an accumulator to absorb hydraulic fluid that is quickly shuttled into and out of the system, as well as to handle the rapid pressure changes (i.e. from high pressure to low pressure and visa-versa) that occur in the system as a result of high speed actuation. The very nature of accumulators dictates that they be sufficiently robust to withstand high and rapidly changing pressures. Compliance issues also require that the accumulators be located as closely as possible to the lost motion element with which they are in hydraulic communication. Compliance issues also mandate that the lost motion system, and to some degree, the accumulator, be adapted to bleed air from the working fluid thereby reducing the compressibility of the fluid.

Locating an accumulator near a lost motion element, particularly one integrated into an engine rocker arm, constrains the size and weight of the accumulator, which in turn affects the designers ability to make the accumulator robust. There is a natural inverse relationship between the robustness of an accumulator and its size and weight. The smaller and lighter the accumulator, the less robust it tends to be. Thus, the combination of loading and space requirements of accumulator pistons associated with integrated engine brakes provides a challenge to engine brake designers. In view of the foregoing, there is a need for an accumulator that is reduced in size, cost effective, sufficiently robust, capable of bleeding air, and controllable.

It has been determined that control over the amount of hydraulic fluid that the accumulator is designed to accumulate may be particularly important to the operation of the lost motion system. Without precise accumulator control, an engine valve may experience over-travel or under-travel. Moreover, imprecise accumulator control may have a negative impact on control and consistency of engine valve seating timing and velocities.

Engine valve over-travel during main events may result in valve to piston contact or the need for valve pockets in the piston. Neither valve to piston contact, nor valve pockets are desirable. Under-travel may lead to ineffective auxiliary valve events, such as compression-release events, or ineffective overlap between main intake and exhaust events. In order to reduce the likelihood of valve over-travel or under-travel, and to provide desirable valve seating timing and velocities, Applicant has developed an accumulator that absorbs a predetermined fixed volume of hydraulic fluid upon each actuation cycle of the engine brake. This accumulator provides the ability to lose the precise amount of motion provided by an engine brake lobe, or another auxiliary lobe on the exhaust cam. The loss of this precise amount of motion permits the engine valve to seat consistently, and the engine piston to be provided without pockets, while avoiding the likelihood of valve to piston contact.

Accumulator design must also take into account the undesired heating of the hydraulic fluid used in the lost motion system. Typically, engine oil is used as the working hydraulic fluid. Such engine oil enters the system already somewhat heated due to its use in the operation of the engine. The oil in the lost motion system is further heated as a result of flowing rapidly through the passages that make up the system. It would therefore be beneficial to provide accumulators with some means of cycling hydraulic fluid through the lost motion system so that there is a constant influx of fresh cool fluid into the system.

In order to provide an accumulator with all of the foregoing beneficial characteristics, Applicant has developed an accumulator that may be integrated into a lost motion piston, such as a slave piston. Such an integrated accumulator saves space and cost due to the use of the slave piston bore as the bore for the accumulator. The integrated accumulator is also capable of being quite robust because it may be manufactured of the same strength steel used for the slave piston.

Applicant has also developed an accumulator capable of providing a precise amount of lost motion clipping of a main engine valve event. Such precise clipping is attained through use of a fixed volume or fixed displacement accumulator. Clipping without a fixed volume may either result in too much, or too little engine valve travel being removed. The later may result in valve-to-piston contact, and the former may cause the valve to be seated at a higher velocity than desired. At a minimum, this may lead to increased engine valve seat wear, and possibly to some form of engine valve failure.

In accordance with embodiments of the present invention, it is contemplated that the accumulator system may be located in a master piston, a slave piston, or separate piston. It is further contemplated that in accordance with the present invention the accumulator system may be located within a rocker arm assembly of an engine rocker brake.

OBJECTS OF THE INVENTION

It is therefore an object of the present invention to provide a lost motion system accumulator with improved robustness for its size.

It is another object of the present invention to provide a lost motion system accumulator that reduces accumulator bore wear.

It is another object of the present invention to reduce the package size of a lost motion system accumulator.

It is a further object of the present invention to provide a more cost effective method for packaging a lost motion system accumulator.

It is still another object of the present invention to reduce some of the variances of bleed rate for a lost motion system accumulator due to pressure differentials.

It is yet another object of the present invention to improve braking performance by improving compliance of a lost motion system accumulator.

It is still yet another object of the present invention to provide a lost motion system accumulator capable of venting and/or absorbing a fixed volume of hydraulic fluid to eliminate valve-to-piston clearance issues.

It is still another object of the present invention to provide a lost motion system accumulator with desirable air bleeding and hydraulic fluid circulation capabilities.

It is still another object of the present invention to provide a lost motion system accumulator that will reduce engine valve spring stresses as a result of fixed volume accumulator.

It is still another object of the present invention to provide a lost motion system accumulator that provides lower engine valve seating velocities.

It is still another object of the present invention to provide a lost motion system accumulator that provides more consistent valve seating timing and velocities.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicant has developed an innovative, economical method or system for providing a lost motion accumulator that uses a captive (fixed) volume that can be selectively hydraulically or pneumatically locked, or vented in order to maintain or increase the total volume of the lost motion system.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

BRIEF DESCRIPTION OF THE DRAWINGS

The invention will now be described in conjunction with the following drawings in which like reference numerals designate like elements and wherein.

DETAILED DESCRIPTION OF THE PREFERRED EMBODIMENTS

Figure 1:
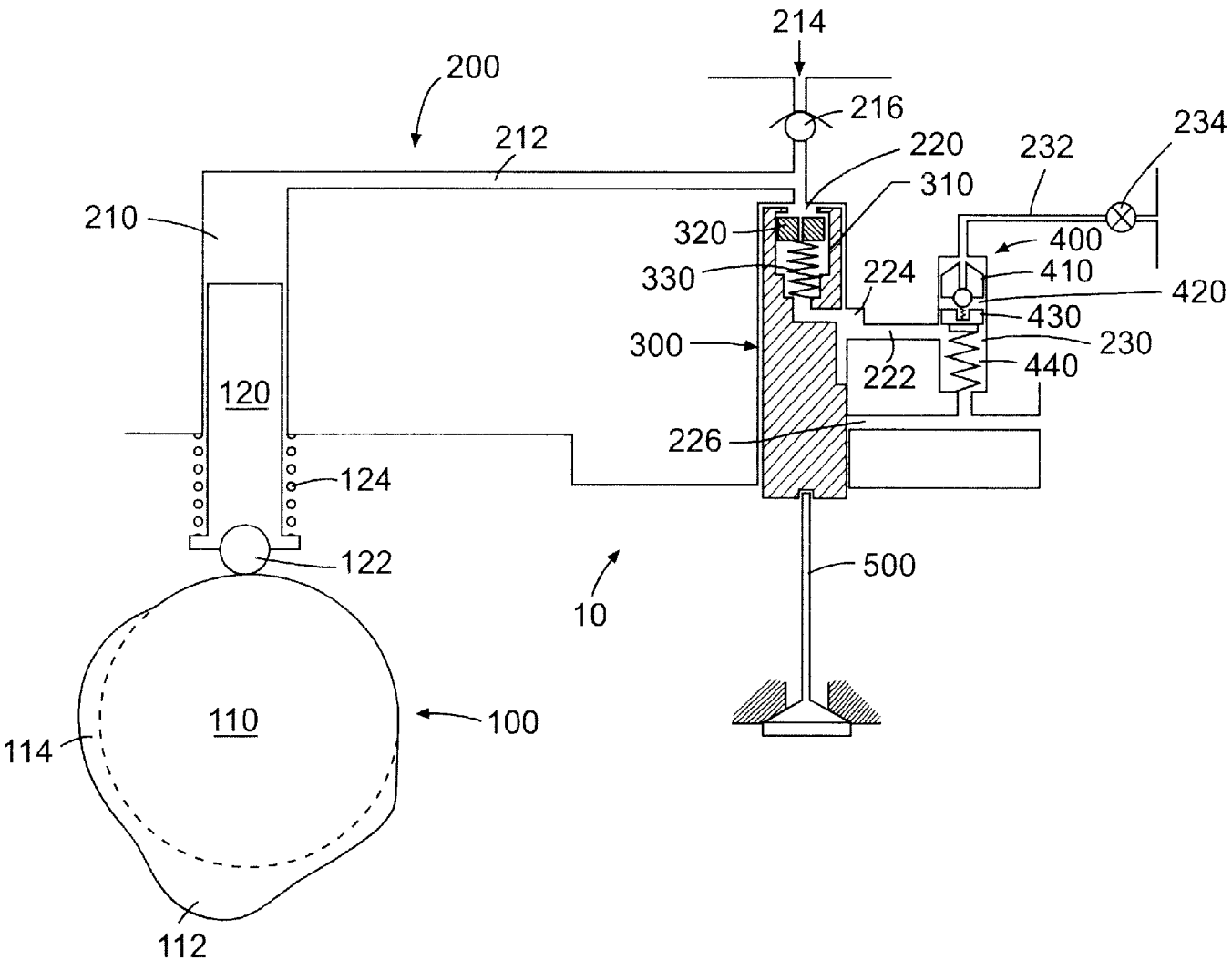
FIG. 1 is a schematic view of a captive volume accumulator system in accordance with a first embodiment of the present invention.

A first embodiment of the present invention is shown as accumulator system 10 in FIG. 1. The system 10 includes an energy source 100, which provides the necessary energy to operate at least one engine valve 500. The energy source 100 supplies energy to an energy transfer assembly 200. The energy transfer assembly 200 transfers energy derived from the energy source 100 to an actuating assembly 300, which activates the at least one engine valve 500. A control assembly 400 may be provided to control the amount of energy and/or the amount of motion transferred by the energy transfer assembly 200 to the actuating assembly 300.

With continued reference to FIG. 1, the energy source 100 may comprise a cam 110 as well as other typical valve train elements. The cam 110 may have at least one lobe 112 thereon to provide energy to perform a main engine valve event and at least one lobe 114 to provide energy to perform a secondary engine valve event. The main engine valve event may be a main exhaust event. The secondary engine valve event may include a compression-release braking event and/or an exhaust gas recirculation event. The present invention, however, is not limited to the use of a cam 110 as an energy source to operate the at least one engine valve 500, rather, it is contemplated that other suitable sources of energy may be employed without departing from the scope of the invention.

The cam 110 may be in operational contact with a roller follower 122 provided on a master piston 120. The master piston 120 may be slidably disposed in a master piston bore 210 and biased into contact with the cam 110 by the master spring 124. The master piston bore 210 may be charged with hydraulic fluid from a low pressure supply passage 214. Oil supplied by passage 214 flows into the system 10, past a check valve 216, and through a passage 212. Oil from the passage 212 fills the master piston bore 210 and enters the slave piston bore 220.

Figure 13:
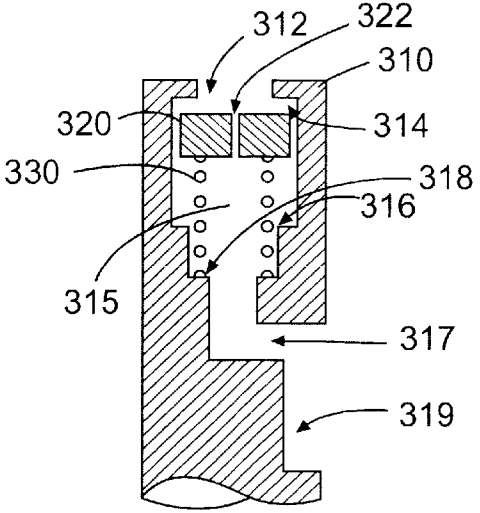
FIG. 13 is a detailed view of the slave piston and accumulator assembly shown in FIG. 1.

A slave piston 300 may be slidably disposed in the slave piston bore 220. The slave piston 300 may include a slave piston body 310, an accumulator piston 320, and an accumulator spring 330. A detailed illustration of the upper portion of the slave piston 300 is shown in FIG. 13. As shown in FIG. 13, the travel of the accumulator piston 320 may be limited by an upper shoulder 314 and a lower shoulder 316. The upper shoulder 314 may define a central opening 312 through which hydraulic fluid pressure can be applied to the accumulator piston 320. The upper shoulder 314 may control the maximum volume of oil that may be contained in the accumulator chamber 315. The arrangement shown in FIG. 13 provides for automatic lash take up between the slave piston 300 and the engine valve 500.

The accumulator piston 320 may include a bleed passage 322 that may provide controlled or resultant leakage into the accumulator chamber 315. The accumulator spring 330 may bias the accumulator piston 320 against the upper shoulder 314 when low pressure oil is provided to the slave piston bore 220. The accumulator spring 330 may seat on an internal land 316.

A passage 317 provides hydraulic communication between the chamber 315 containing the accumulator piston 320 and the sidewall of the slave piston body 310. An annulus or recess 319 may be provided in the slave piston sidewall to facilitate a predetermined amount of hydraulic communication between the accumulator chamber 315 and the control valve bore 230 (shown in FIG. 1).

With renewed reference to FIG. 1, a control passage 222 provides hydraulic communication between the control valve bore 230 and the slave piston bore 220. The control passage 222 may include an enlarge portion 224 that is designed to provide a predetermined amount of hydraulic communication between the slave piston and control valve bores.

A control valve 400 may be slidably disposed in the control valve bore 230. The control valve may comprise a check valve body 410, a check ball 420, a check ball spring 430, and a control valve spring 440. A first end of the control valve bore 230 may connect to a control fluid supply passage 232 that selectively supplies hydraulic fluid to the control valve 400 under the control of a solenoid valve 234. A second end of the control valve bore 230 may connect to a vent passage 226 that communicates with the atmosphere or a second accumulator (not shown). If the vent passage 226 connects to a second accumulator, the vented fluid may eventually be returned to the fluid supply, and thus the fluid supply passage 232. The control valve 400 may either be a fast or slow acting mechanical, electro-mechanical, electro-magnetic, pneumatic, or hydraulic valve that controls the communication of the accumulator chamber 315 with the vent passage 226. The check valve 410 portion of the control valve 400 can also supply low pressure oil to the system 10.

With continued reference to FIG. 1, the control valve 400 is in an "off" position. The off position is defined as that in which the solenoid valve 234 does not have power supplied to it and the control valve body 410 is at the resting position. When in the off position, the control valve 400 permits hydraulic communication between the accumulator chamber 315 and the vent passage 226 by way of the passage 222. The off position of the control valve 400 is used to provide positive power engine valve operation (i.e. no compression-release braking).

During positive power operation, the system 10 is charged with low pressure oil from the passage 214. The check valve 216 prevents the oil provided to the master piston bore 210 and the slave piston bore 220 from flowing back towards the low pressure supply, and thus provides automatic lash take up. The oil provided from the passage 214 is not sufficiently pressurized to depress the accumulator spring 330. Thus, the accumulator piston 320 remains biased against the upper shoulder 314 when the master piston 120 is at base circle (as shown).

As the cam 110 rotates, the master piston 120 is displaced upward by a secondary lobe 114. The displacement of the master piston 120 causes the accumulator piston 320 to be correspondingly displaced downward against the bias of the accumulator spring 330 into the accumulator chamber 315 relative to the slave piston body 310. From an observation point outside of the slave piston 300, the accumulator piston 320 may move downward to some degree and the slave piston body 310 may move upward to some degree, in accordance with the hydraulic ratios of these elements that is dependent on the relative diameters of the slave piston bore 220 and the accumulator chamber 315. Relative movement of the accumulator piston 320 and the slave piston body 310 causes the accumulator spring 330 to be depressed because as between it and the engine valve spring (not shown) it provides a lower biasing force. The volume of the accumulator chamber 315 is designed to fully absorb the oil displaced by the master piston 120 as a result of encountering the secondary lobe 114. The lower shoulder 316 may be located such that the accumulator piston 320 engages the lower shoulder just as the maximum displacement produced by the secondary lobe 114 is applied to the master piston 120.

After encountering the secondary lobe 114, the master piston 120 is displaced further by the main event lobe 112. The additional displacement of oil by the master piston 120 can no longer be absorbed by the accumulator piston 320 because it is already in contact with the lower shoulder 316 as a result of the displacement caused by the secondary lobe 114. Thus, the additional displacement of hydraulic fluid by the master piston 120 causes the slave piston body 310 to slide downward in the slave piston bore 220 against the bias of the engine valve spring (not shown). In this manner, the main event lobe 112 may converted to a main event opening motion for the engine valve 500.

Seating of the engine valve 500 occurs as the master piston 120 follows the cam 110 into the saddle of the second base circle (i.e. the secondary lobe 114). As the master piston 120 follows the cam 110 onto the first base circle, the slave piston 310 and the accumulator piston 320 return to their upper rest positions.

In the positive power mode, the bleed passage 322 is constantly operational. This passage provides system cooling by continuously replacing heated, worked oil with fresh, cooler oil from the supply passage 214.

In order to place the engine in compression-release braking mode, the solenoid valve 234 may be actuated (or de-actuated, depending on whether the solenoid is arranged as normally open or normally closed). Actuation of the solenoid valve 234 causes low pressure hydraulic fluid to be applied to the control valve 400 through the passage 232. The oil pressure applied to the control valve 400 causes it to be displaced downward against the bias of the control valve spring 440. In this position the control valve 400 blocks hydraulic communication between the passage 222 and the vent passage 226. The check ball 420 of the control valve 400, however, permits the one way flow of oil into the high pressure circuit (passage 222 and slave piston bore 220), but not back out of the high pressure circuit. The check ball 420 allows oil to fill the accumulator chamber 315 as the accumulator piston 320 re-attains its upper most position when the cam 110 returns to base circle.

When the solenoid valve 234 is "on", and the cam 110 is at base circle, the accumulator piston 320 is hydraulically locked into its upper position against the upper shoulder 314. As the cam 110 rotates, the master piston 120 is first displaced upward by the secondary lobe 114. Because the accumulator piston 320 is locked into position, the displacement of the master piston 120 by the secondary lobe 114 causes a corresponding downward displacement of the slave piston 310. The downward motion of the slave piston 310 may in turn open the engine valve 560 for a compression-release event.

After the compression-release braking event occurs, the master piston may be further displaced by main event lobe 112 on the cam 110. The main event lobe 112 cause the slave piston 320 to be further displaced, opening the engine valve 500 for its main event. At a certain point on the main event lobe profile, the recess 319 provided in the slave piston 310 comes into hydraulic communication with the vent passage 226. When this communication occurs, the high pressure hydraulic fluid locking the accumulator piston 320 into its upper position is released to atmosphere or a second accumulator. This permits the accumulator piston 320 to move downward in the accumulator chamber 315 relative to the slave piston body 310 until it comes to rest on the lower shoulder 316. Thus, communication of the recess 319 with the vent passage 226 permits the accumulator piston 320 to absorb the precise amount of additional motion provided by the secondary cam lobe 114. In this manner, the main event motion provided to the engine valve 500 during engine braking operation is limited to the same amount of motion that is provided by a main event during positive power operation. Therefore, the present invention provides the same valve-to-piston clearance during positive power and engine braking operation.

It is appreciated that the afore-described process could be modified such that an exaggerated main exhaust event is provided by maintaining the control valve 400 in its positive power position during engine braking.

The bleed passage 322 provided in the accumulator piston 320 does not affect the ability of the accumulator piston to be hydraulically locked, which eliminates the variability of orifice bleeding that may ordinarily result from system pressure variations. When the accumulator chamber 315 is vented through the vent passage 226, however, the bleed passage 322 is also able to vent. A certain amount of oil will be bled through the system each time the accumulator chamber 315 is placed in communication with the vent passage 226. The position of the vent passage 226 may be selected so as to be anywhere in the range of valve lift for the main event, as long as it is less than the peak lift minus the lost motion portion of the lift. Oil for hydraulic lash adjustment and recovery from lost oil may be regained through the high-pressure check valve contained in the control valve 400.

The engine valve 500 will seat as the master piston 120 follows the cam 110 back into the saddle of the second base circle (i.e. secondary event 114). As the master piston 120 begins to travel down the last ramp of the secondary event 114 to the first base circle, the accumulator piston 320 will reset to its upper position under the influence of oil provided through the control valve 400.

Figure 6:
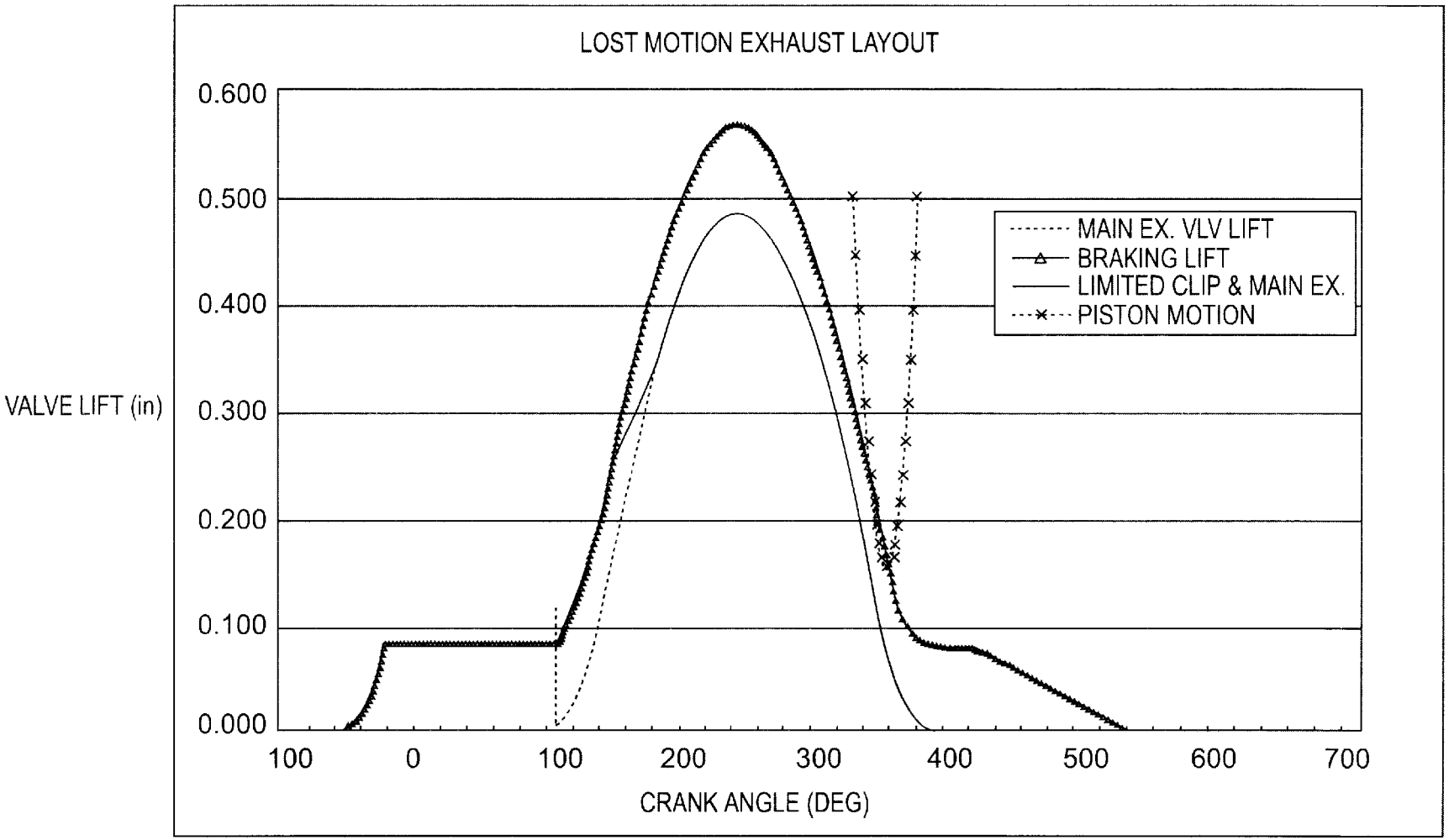
FIG. 6 is a graphical representation of a valve lift profile according to an embodiment of the present invention.

FIG. 6 is a graphical representation of valve lift as disclosed in the present invention. In a lost motion system, where the cam profile has two events: one which can be suppressed, and the second is additive to the first (see FIG. 6—Braking Lift). This leads to valve to piston clearance issues. A method of eliminating this over-travel, is to vent a fixed volume of oil. If the volume of oil is equal to the amount of lift of the first bump, then the valve will seat a shown. This process can be accomplished with any lost motion system and can use any means to enact the venting of the hydraulic volume.

Figure 2:
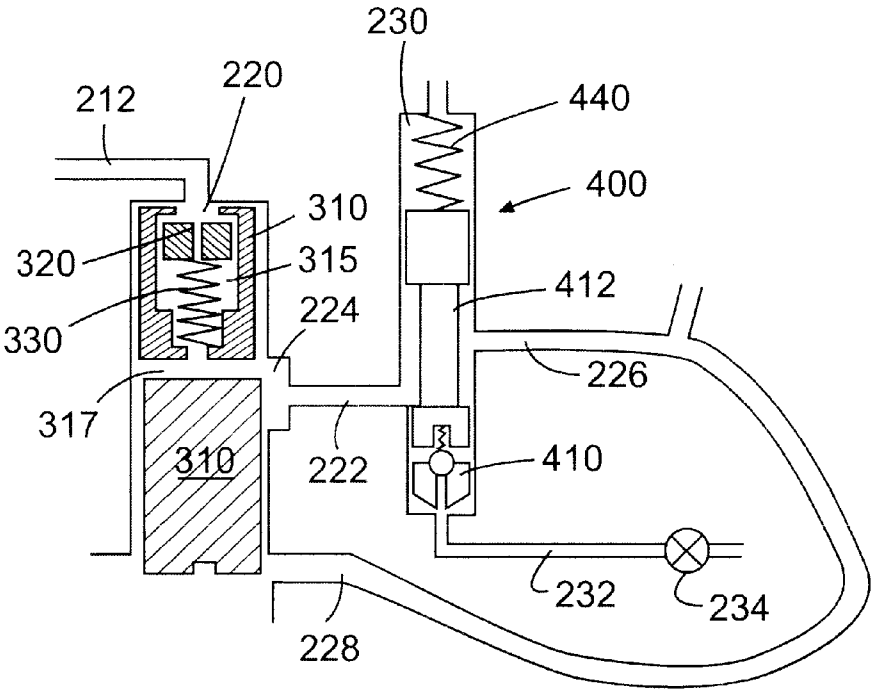
FIG. 2 is a schematic view of a captive volume accumulator system in accordance with a second embodiment of the present invention.

A second embodiment of the present invention is shown in FIG. 2, in which like reference numerals refer to like elements. The operation of the system shown in FIG. 2 is similar to that of the system shown in FIG. 1. In FIG. 2, a spool valve 412 that includes a check valve at one end serves as the control valve 400. When the spool valve 412 is in the position shown, the accumulator piston 320 is free to be displaced in the accumulator chamber 315 as the result of high pressure received through the passage 212. Displacement of the accumulator piston 320 causes the oil in the chamber 315 to be vented through the vent passage 226.

The system shown in FIG. 2 may provide compression-release braking by actuating the solenoid valve 234, which in turn causes oil to flow through the passage 232 and displace the spool valve 412 upward. This displacement of the spool valve 412 blocks communication between the passage 222 and the vent passage 226, thereby hydraulically locking the accumulator piston 320 into its upper position. One way flow of oil into the accumulator chamber 315 is permitted by the check valve end 410 of the control valve 400. Unlocking of the accumulator piston 320 during the main engine valve event may occur as a result of either communication between the slave piston passage 317 and the secondary vent passage 228, or the high speed actuation of the spool valve 412 with an mechanical, electro-mechanical, electro-magnetic, pneumatic, or hydraulic actuator. The secondary vent passage 228 may communicate with the vent passage 226.

The system shown in FIG. 2 (as well as that shown in FIGS. 3 and 5) may also benefit from the isolation of the spring 440 from the hydraulic pulses that may occur in the vent passage 226.

Figure 3:
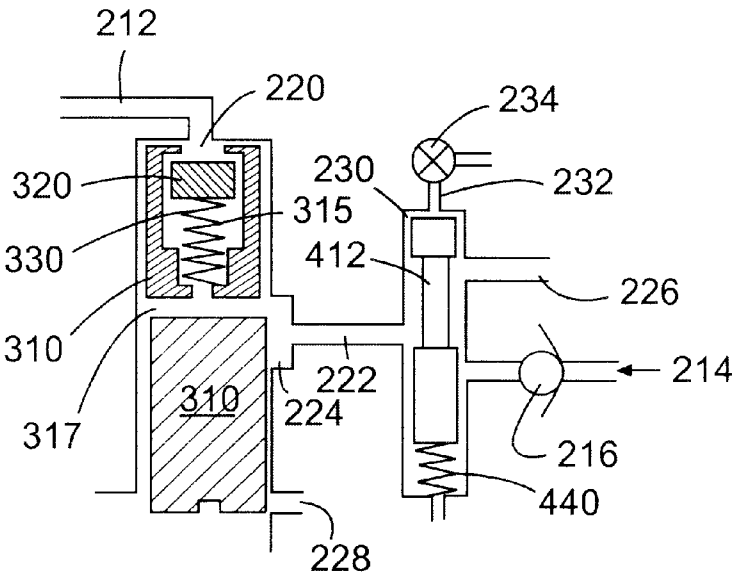
FIG. 3 is a schematic view of a captive volume accumulator system in accordance with a third embodiment of the present invention.

A third embodiment of the present invention is shown in FIG. 3, in which like reference numerals refer to like elements. The operation of the system shown in FIG. 3 is similar to that of the system shown in FIG. 2. In FIG. 3, a spool valve 412 serves as the control valve 400. The spool valve 412 provides communication with the slave piston bore 220 alternatively with a vent passage 226 (during positive power operation) or with a constant checked supply of low pressure oil from a low pressure passage 214 (during engine braking operation). When the spool valve 412 is in the position shown, the accumulator piston 320 is free to be displaced in the accumulator chamber 315 as the result of high pressure received through the passage 212. Displacement of the accumulator piston 320 causes the oil in the chamber 315 to be vented through the vent passage 226.

With continued reference to FIG. 3, compression-release braking operation may be provided by actuating the solenoid valve 234, which in turn causes oil to flow through the passage 232 and displace the spool valve 412 downward. This displacement of the spool valve 412 blocks communication between the passage 222 and the vent passage 226, and opens communication between the supply passage 214 and the passage 222, thereby hydraulically locking the accumulator piston 320 into its upper position. One way flow of oil into the accumulator chamber 315 is permitted by the check valve 216. Unlocking of the accumulator piston 320 during the main engine valve event may occur as a result of either communication between the slave piston passage 317 and the secondary vent passage 228, or the high speed actuation of the spool valve 412 via high speed actuation of the solenoid valve 234. The secondary vent passage 228 may communicate with the vent passage 226. The control valve 400 may either be a fast or slow acting mechanical, electro-mechanical, electro-magnetic, pneumatic, or hydraulic valve that controls the communication of the accumulator chamber 315 with the vent passage 226.

Figure 4:
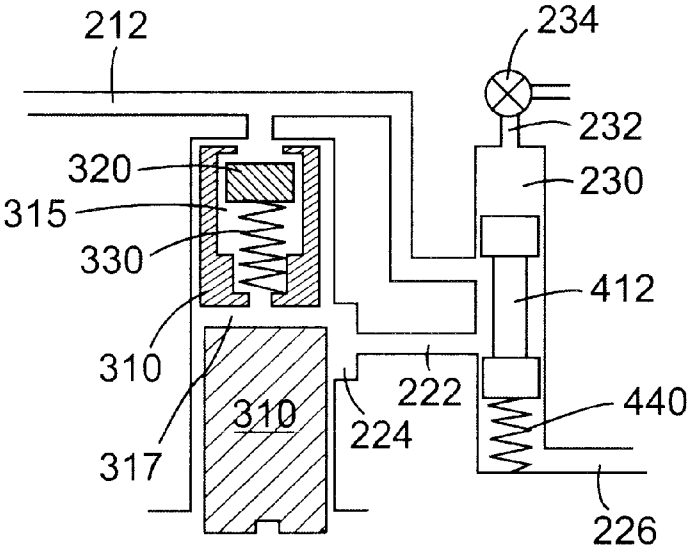
FIG. 4 is a schematic view of a captive volume accumulator system in accordance with a fourth embodiment of the present invention.

A fourth embodiment of the present invention is shown in FIG. 4, in which like reference numerals refer to like elements. In this embodiment, the spool valve 412 alternatively connects the passage 222 (and thus the accumulator chamber 315) to either the vent passage 226 or a high pressure hydraulic fluid supply passage 212. The solenoid valve 234 may control the position of the spool valve 412.

When the solenoid valve 234 blocks the flow of hydraulic fluid into the control valve bore 230, the spool valve 412 is biased upward and provides communication between the passage 222 and the vent passage 226. When the solenoid valve 234 supplies hydraulic pressure, the spool valve 412 is biased down into the position shown so that the vent passage 226 is closed and the high-pressure passage 212 is placed in communication with the accumulator chamber 315.

Figure 5:
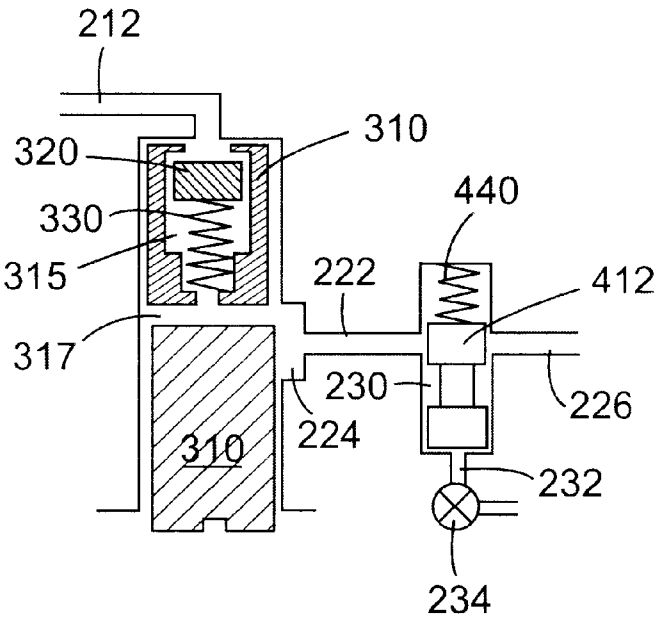
FIG. 5 is a schematic view of a captive volume accumulator system in accordance with a fifth embodiment of the present invention.

A fifth embodiment of the present invention is shown in FIG. 5, in which like reference numerals refer to like elements. With reference to FIG. 5, a spool valve 412 with a bleed fill may be provided. During engine braking operation, the spool valve 412 is displaced upward against the bias of the control valve spring 440. In this position, the accumulator chamber 315 is permitted to vent through the vent passage 226 to either the atmosphere, or a second accumulator that is connected back to the high-pressure circuit, to aid in re-fill. During positive power operation, the spool valve 412 is positioned as shown so that the vent passage 226 is blocked. The accumulator chamber 315 may be filled by leakage from the high-pressure passage 212 past the accumulator piston 320. This leakage fill feature is further enhanced by the incorporation of a constant bleed passage 322 (shown in FIG. 1) into the accumulator piston 320.

Figure 7:
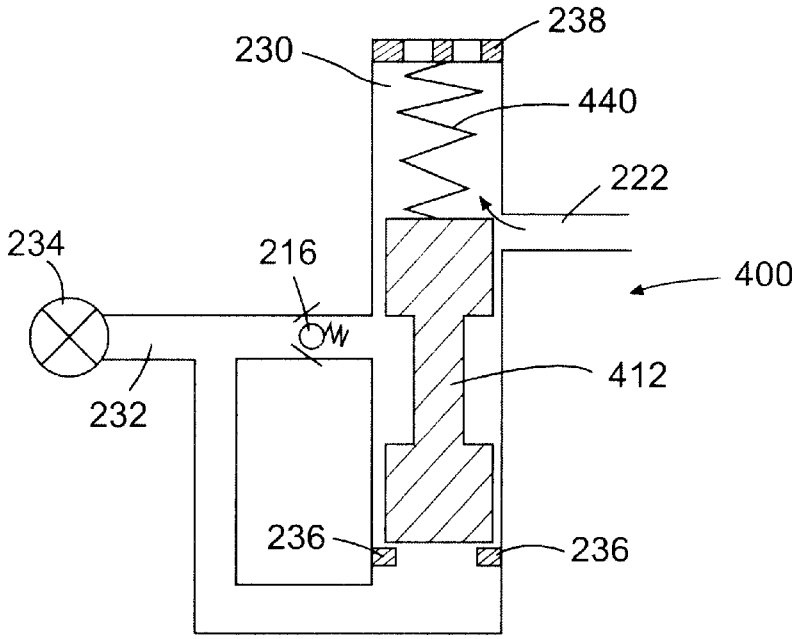
FIG. 7 is a schematic view of an accumulator control valve in an "OFF" position in accordance with a sixth embodiment of the present invention.
Figure 8:
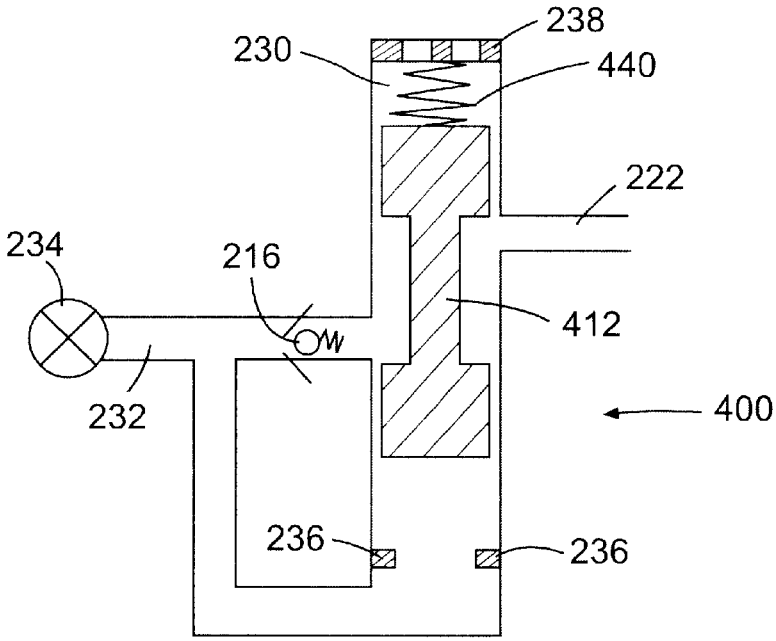
FIG. 8 is a schematic view of the control valve of FIG. 7 in an "ON" position.

With reference to FIG. 7, an accumulator control valve 400 configured in accordance with a seventh embodiment of the present invention is shown, in which like reference numerals refer to like elements. With reference to FIG. 7, the spool valve 412 may be controlled via the application of low pressure hydraulic fluid from the passage 232. The spool valve 412 may provide the passage 222 (connected to the accumulator chamber 315) with communication alternatively with the atmosphere through the vent plate 238 or with the checked low pressure supply via the check valve 216. The passage 222 is offset from the passage 232 and the spool valve 412 is positioned so that the low pressure, supply passage does not ever communicate with the vent plate 238. As a result of the foregoing arrangement, the application of low pressure hydraulic fluid in the passage 232 immediately causes the spool valve 412 to index upward and block communication between the passage 222 and the vent plate 238. FIG. 7 shows the spool valve 412 in the position required for positive power operation (primary mode) of the lost motion system. FIG. 8 shows the same spool valve 412 as is shown in FIG. 7 in the position required for engine braking operation (secondary mode). The control valve 400 may either be a fast or slow acting mechanical, electro-mechanical, electro-magnetic, pneumatic, or hydraulic valve that controls the communication of the accumulator chamber 315 with the vent passage 226.

Figure 10:
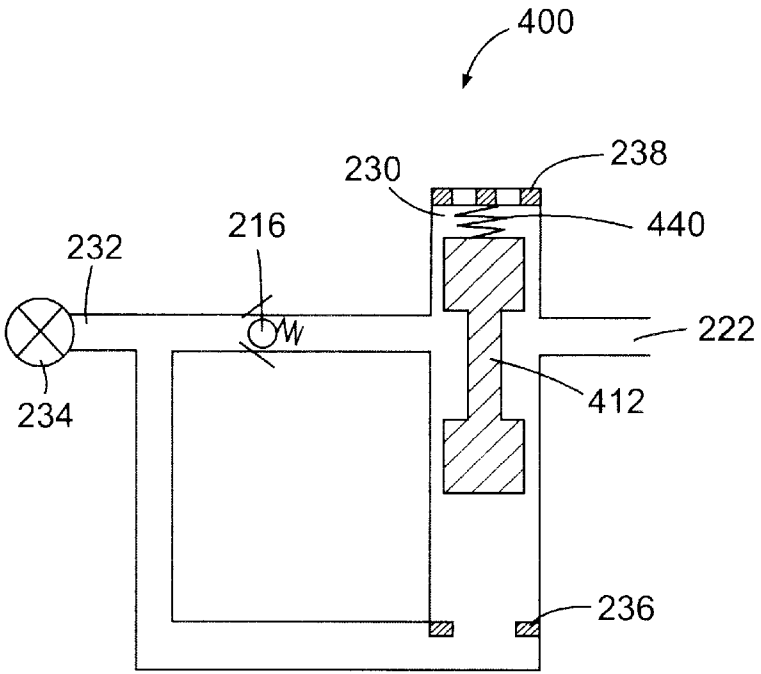
FIG. 10 is a schematic view of the control valve of FIG. 9 in an "ON" position.
Figure 9:
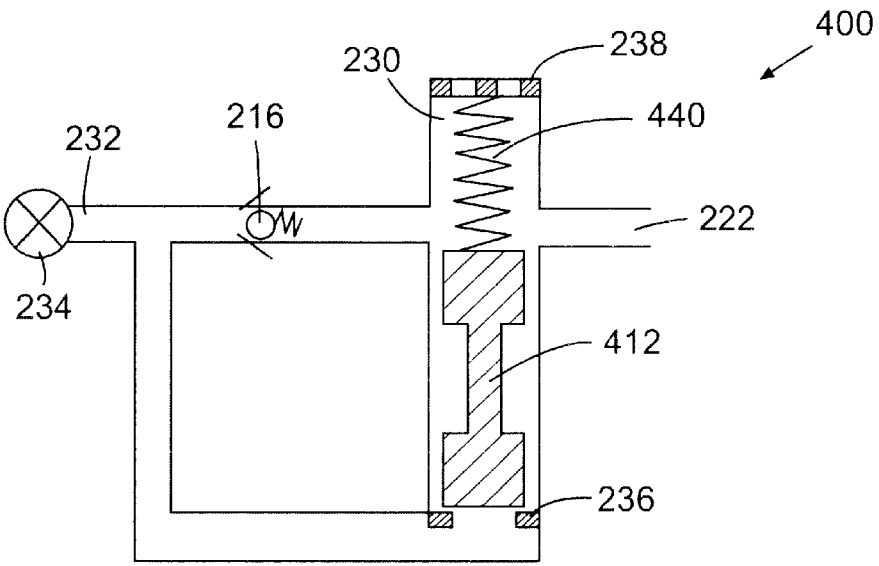
FIG. 9 is a schematic view of an accumulator control valve in an "OFF" position in accordance with a seventh embodiment of the present invention.

With reference to FIG. 9, an accumulator control valve 400 configured in accordance with a sixth embodiment of the present invention is shown, in which like reference numerals refer to like elements. With reference to FIG. 9, the spool valve 412 may be controlled via the application of low pressure hydraulic fluid from the passage 232. The spool valve 412 may provide the passage 222 (connected to the accumulator chamber 315) with communication alternatively with the atmosphere through the vent plate 238 or with the checked low pressure supply via the check valve 216. The passage 222 is located directly across from the passage 232, which simplifies manufacturing of the system. The spool valve 412 is positioned so that the passage 232 communicates with the vent plate 238 when the spool valve is in an "off" position. As a result of the foregoing arrangement, the application of low pressure hydraulic fluid in the passage 232 does not immediately cause the spool valve 412 to index upward and block communication between the passage 222 and the vent plate 238. Spool valve 412 indexes upward only after the combined flow of oil past the check valve 216 and the vent plate 238 backs up sufficiently to allow hydraulic pressure to build underneath the spool valve. FIG. 9 shows the spool valve 412 in the position required for positive power operation of the lost motion system. FIG. 10 shows the same spool valve 412 as is shown in FIG. 9, in the position required for engine braking operation. The control valve 400 may either be a fast or slow acting mechanical, electro-mechanical, electro-magnetic, pneumatic, or hydraulic valve that controls the communication of the accumulator chamber 315 with the vent passage 226.

Figure 12:
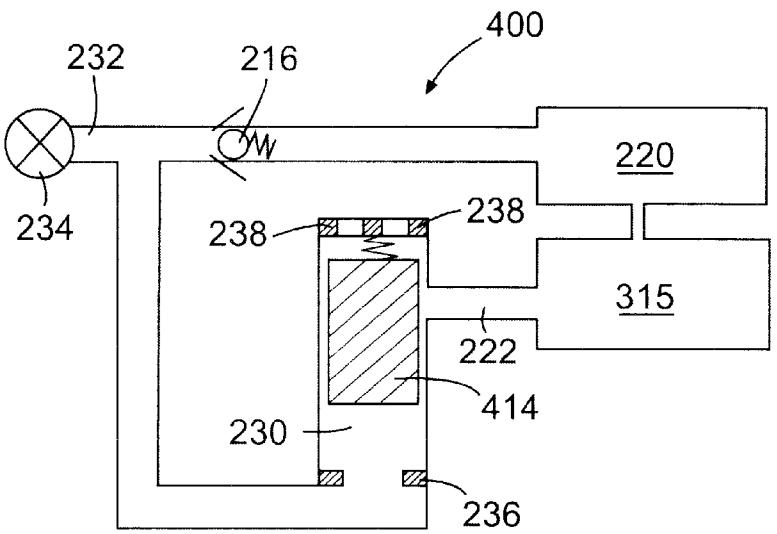
FIG. 12 is a schematic view of the control valve of FIG. 11 in an "ON" position.
Figure 11:
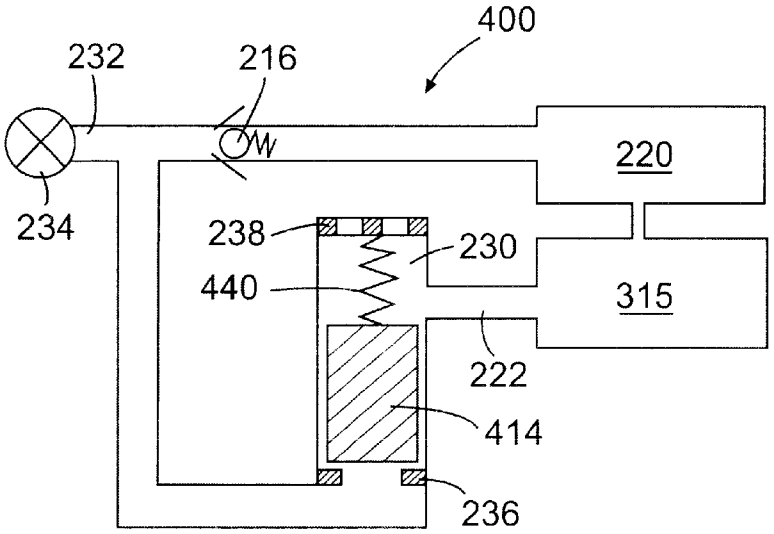
FIG. 11 is a schematic view of an accumulator control valve in an "OFF" position in accordance with an eighth embodiment of the present invention.

With reference to FIG. 11, an accumulator control valve 400 configured in accordance with a seventh embodiment of the present invention is shown, in which like reference numerals refer to like elements. With reference to FIG. 11, the slug 414 may be controlled via the application of low pressure hydraulic fluid from the passage 232. The slug 414 may selectively block the flow of hydraulic fluid from the accumulator chamber 315 to the atmosphere through the vent plate 238. Actuation of the control valve 400 occurs due to the combination of the length of the passage 232 that connects to the accumulator bore 220 and the restriction provided by the check valve 216 being sufficient to delay the actuation of the slave piston body until after the slug 414 is indexed upward to block the vent plate 238. FIG. 11 shows the slug 414 in the position required for positive power operation of the lost motion system. FIG. 12 shows the same slug 414 as is shown in FIG. 11, in the position required for engine braking operation. The control valve 400 may either be a fast or slow acting mechanical, electro-mechanical, electro-magnetic, pneumatic, or hydraulic valve that controls the communication of the accumulator chamber 315 with the vent passage 226.

Figure 14:
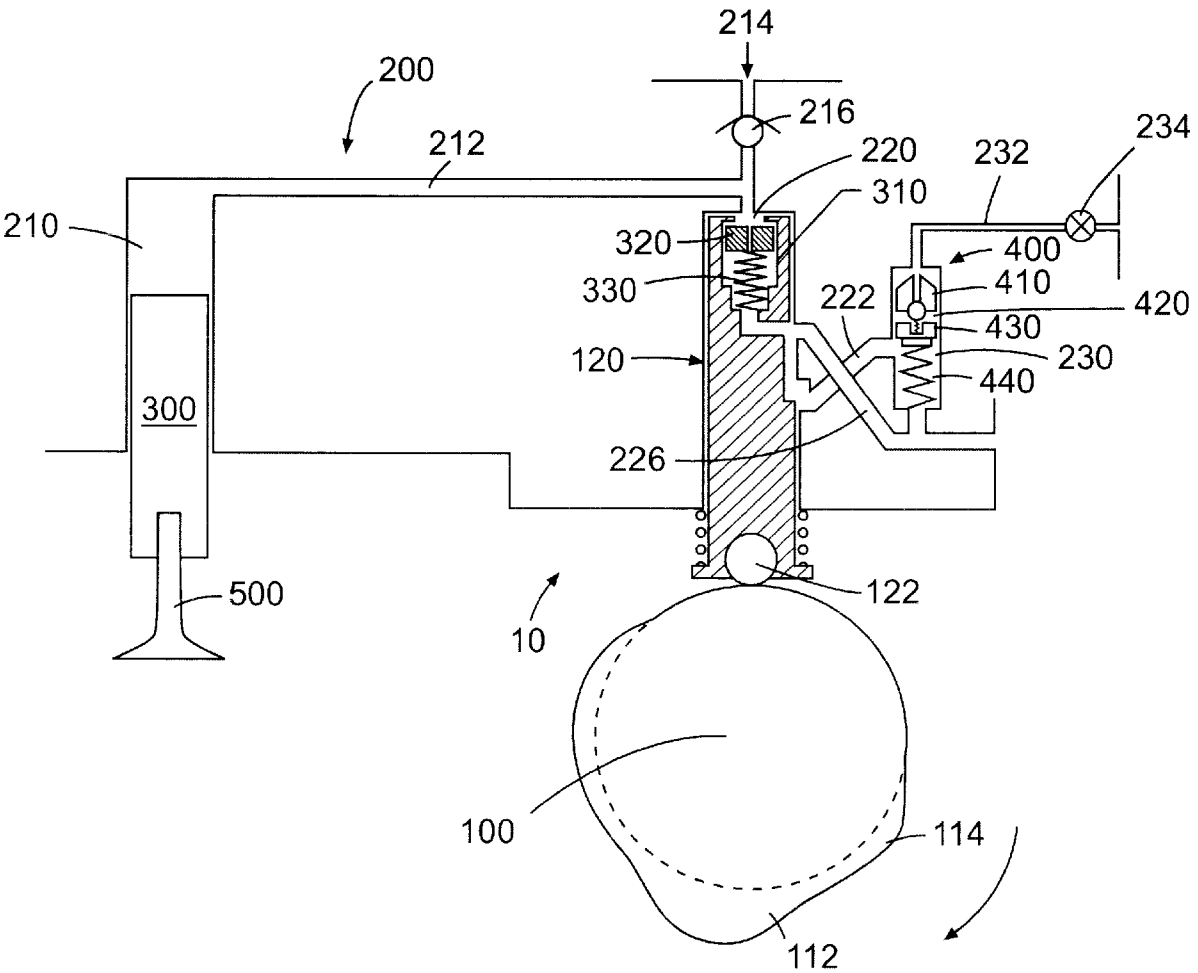
FIG. 14 is a schematic view of a captive volume accumulator system in accordance with a ninth embodiment of the present invention.

In accordance with variations of the present invention, an accumulator vent passage may be placed in communication with the high pressure circuit in the lost motion system 10 through the motion of the slave piston 310, which contains a window to either the atmosphere, or a second accumulator that is connected back to the high-pressure circuit, to aid in re-fill. With reference to FIG. 14, in an alternative embodiment of the invention, an accumulator vent passage may be exposed through the motion of the master piston 120, which contains a window to either the atmosphere or a second accumulator that is connected back to the high-pressure circuit, to aid in re-fill. This may effectively reset the engine valve 500.

Figure 15:
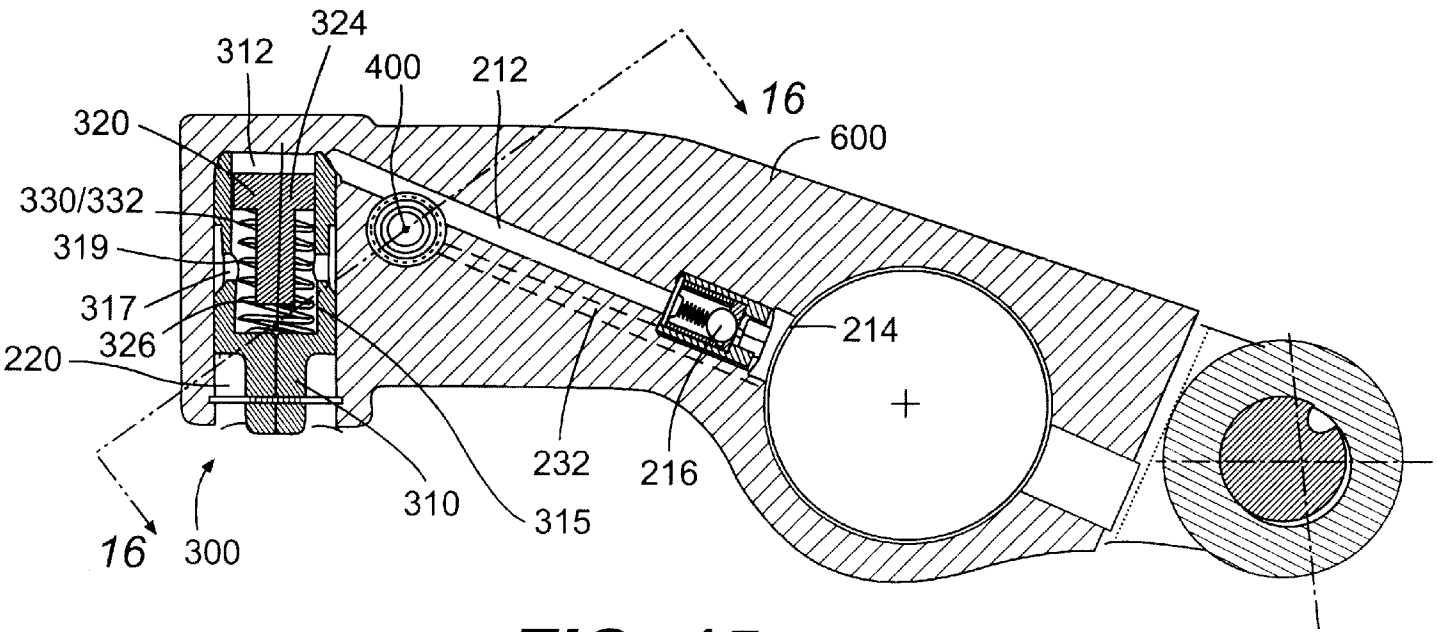
FIG. 15 is a schematic view of a captive volume accumulator system in accordance with a tenth embodiment of the present invention in which the system is integrated into an engine rocker arm.
Figure 16:
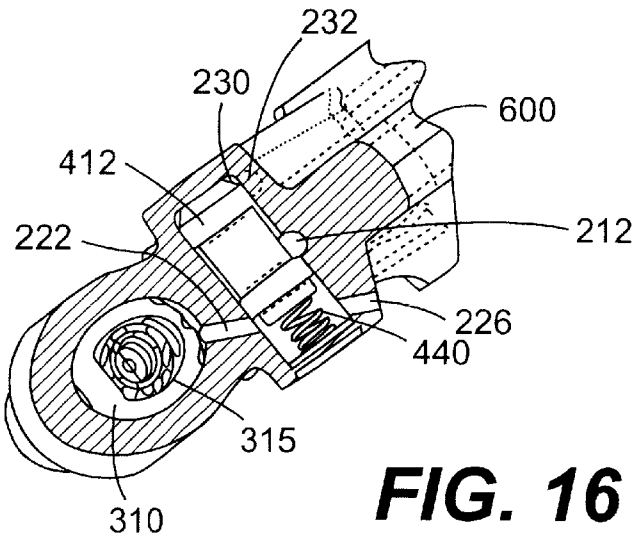
FIG. 16 is a view of the tenth embodiment shown in FIG. 15 along section C—C.

FIGS. 15 and 16 show the slave piston 300 and control valve 400 arrangement of FIG. 4 arranged in a rocker arm 600. FIG. 15 also illustrates the use of a preferred accumulator piston 320 that includes a piston head 324 and a piston stem 326, and dual accumulator springs 330 and 332. The operation of the slave piston 300 and the control valve 400 is the same as that described in connection with FIG. 4 except that the downward force applied to the slave piston is provided by the rotation of the rocker arm 600 in the system shown in FIGS. 15 and 16, as opposed to the master piston 120 in the system of FIGS. 1 and 4. It is appreciated that any of the slave piston/control valve arrangements shown in FIGS. 1–5 and 7–14 may be integrated into a rocker arm as shown in FIGS. 15 and 16. The control valve 400 may either be a fast or slow acting mechanical, electro-mechanical, electro-magnetic, pneumatic, or hydraulic valve that controls the communication of the accumulator chamber 315 with the vent passage 226.

Figure 17:
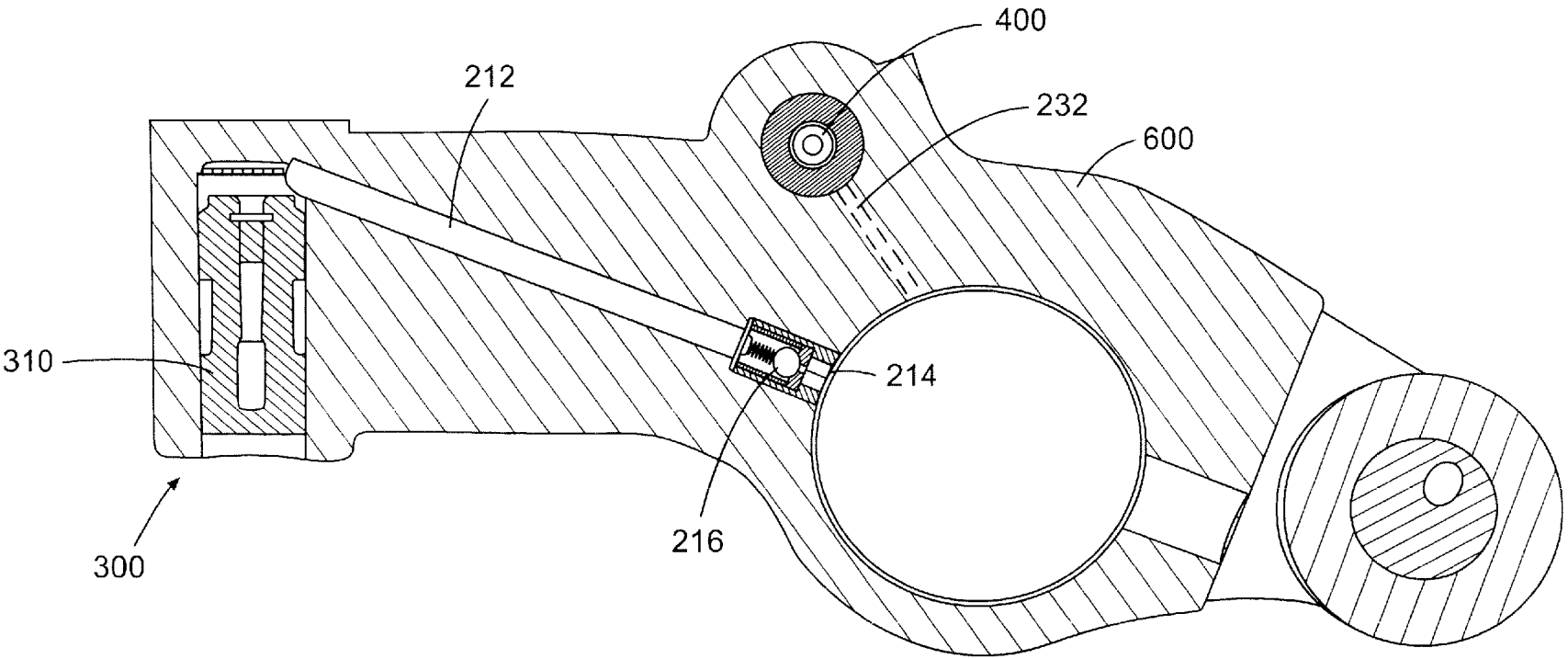
FIGS. 17–19 are illustrations of a captive volume accumulator system in accordance with an eleventh embodiment of the present invention in which the system is integrated into an engine rocker arm.
Figure 18:
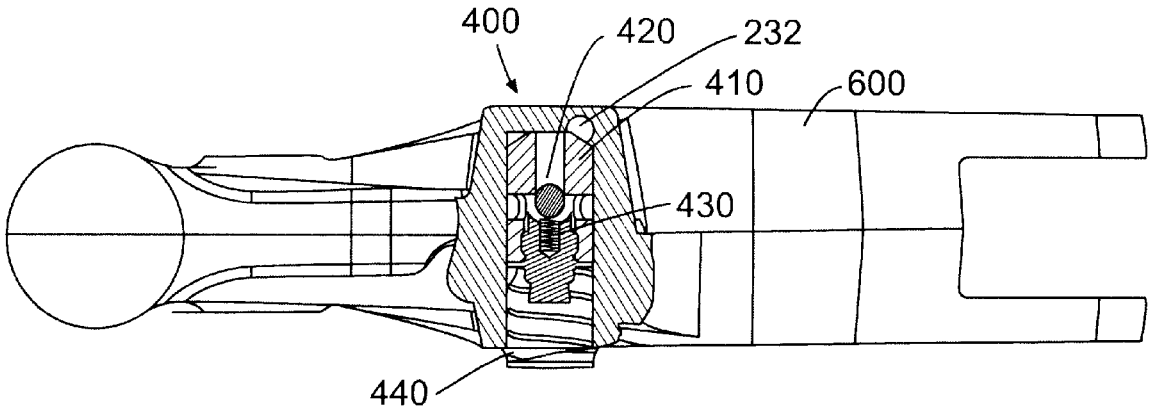
Figure 19:
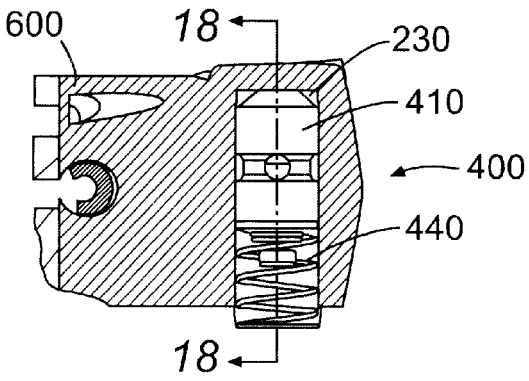

FIGS. 17–19 show the slave piston 300 and control valve 400 arrangement of FIG. 1 arranged in a rocker arm 600.

It will be apparent to those skilled in the art that various modifications and variations can be made in the construction, configuration, and/or operation of the present invention without departing from the scope or spirit of the invention. For example, in the embodiments mentioned above, various changes may be made to the accumulator without departing from the scope and spirit of the invention. Further, it may be appropriate to make additional modifications or changes to the hydraulic system without departing from the scope of the invention. Thus, it is intended that the present invention cover the modifications and variations of the invention provided they come within the scope of the appended claims and their equivalents.

What is claimed:

1. An actuating system located in an engine overhead housing for operating at least one valve of an engine during a plurality of engine operating modes, said system comprising:

energy means for supplying energy to operate the at least one valve during the plurality of engine operating modes;

valve actuation means for actuating the at least one valve during the plurality of engine operating modes, said valve actuation means including an accumulator piston slidably disposed in a slave piston;

energy transfer means for transferring energy from said energy means to said valve actuation means; and control means for controlling the amount of energy transferred from said energy means to said valve actuation means to control the actuation of the at least one valve during the plurality of engine operating modes.

2. The actuating system of claim 1 wherein said accumulator piston is in a locked position during one operating mode such that substantially all of the energy from the energy means is transferred to said valve actuation means.

3. The actuating system of claim 1 wherein the energy means comprises a cam with a primary lobe and an auxiliary lobe, and wherein full displacement of the accumulator piston results in loss of substantially all valve motion produced by the auxiliary lobe.

4. The actuating system of claim 1 wherein the accumulator piston includes a piston head and a piston stem.

5. The actuating system of claim 1 further comprising a bleed passage extending through the accumulator piston.

6. The actuating system of claim 1 wherein the control means includes means for venting fluid supporting the accumulator piston at a predetermined time.

7. The actuating system of claim 1 wherein said accumulator piston is disk-shaped.

8. The actuating system of claim 1 wherein the control means comprises a spool valve.

9. The actuating system of claim 8 wherein the spool valve includes an internal check valve.

10. The actuating system of claim 8 wherein the control means further comprises a check valve located externally of said spool valve.

11. The actuating system of claim 8 wherein the control means includes a spring biasing said spool valve into a position for positive power engine operation.

12. The actuating system of claim 11 wherein the control means includes an hydraulic vent selectively opened by said spool valve.

13. The actuating system of claim 12 wherein the spring biasing the spool valve is isolated from the hydraulic vent.

14. The actuating system of claim 8 wherein the control means includes a solenoid operated valve for selectively controlling fluid supply to the spool valve.

15. The actuating system of claim 1 further comprising at least one spring disposed between the accumulator piston and the slave piston.

16. The actuating system of claim 15 further comprising a bleed passage extending through the accumulator piston.

17. The actuating system of claim 1 wherein the energy transfer means comprises an hydraulic link between a master piston and a slave piston.

18. The actuating system of claim 1 wherein the energy supply means comprises a cam assembly.

19. A system for actuating an engine valve, said system comprising:

an overhead housing hydraulic system;

a plunger and accumulator piston assembly disposed in the overhead housing hydraulic system, said plunger being adapted to apply actuation motion to the engine valve;

means for applying hydraulic pressure to the plunger and accumulator piston assembly, wherein the accumulator piston is adapted to selectively absorb at least a portion of the hydraulic pressure applied to the plunger and accumulator piston assembly so as to selectively lose motion caused by the application of hydraulic pressure thereto; and at least one spring biasing the accumulator piston relative to the plunger.

20. The system of claim 19 wherein the accumulator piston is slidably disposed within a chamber formed in the plunger.

21. The system of claim 20 wherein the accumulator piston includes a head portion and a stem portion, and wherein the at least one spring is concentric with the accumulator piston stem portion.

22. The system of claim 19 further comprising means for controlling relative motion between the accumulator piston and the plunger.

23. The system of claim 22 wherein the plunger includes a passage providing selective hydraulic communication between the plunger chamber and the means for controlling relative motion.

24. The system of claim 22 wherein the means for controlling includes a spool valve.

25. The system of claim 24 further comprising a check valve incorporated into the spool valve.

26. A method of actuating an engine valve using a hydraulically actuated slave piston and accumulator piston assembly disposed in an overhead hydraulic system, said method comprising the steps of:

providing at least one spring biasing the accumulator piston relative to the plunger;

applying hydraulic pressure to the slave piston; and selectively absorbing at least a portion of the hydraulic pressure applied to the slave piston with the accumulator piston so as to selectively lose slave piston motion caused by the application of hydraulic pressure thereto.

* * * * *